US011197513B2

(12) United States Patent
Rinaldi et al.

(10) Patent No.: US 11,197,513 B2
(45) Date of Patent: Dec. 14, 2021

(54) RUNNING SHOE

(71) Applicants: Massimo Rinaldi, Aubrey, TX (US); Massimiliano Pedroni, Quattro Castella (IT); Silvia Poggi, Suzhou (CH)

(72) Inventors: Massimo Rinaldi, Aubrey, TX (US); Massimiliano Pedroni, Quattro Castella (IT); Silvia Poggi, Suzhou (CH)

( * ) Notice: Subject to any disclaimer, the term of this patent is extended or adjusted under 35 U.S.C. 154(b) by 0 days.

(21) Appl. No.: 17/222,775

(22) Filed: Apr. 5, 2021

(65) Prior Publication Data

US 2021/0219654 A1 Jul. 22, 2021

(51) Int. Cl.

| | |
|---|---|
| ***A43B 13/18*** | (2006.01) |
| ***A43B 13/12*** | (2006.01) |
| ***A43B 13/14*** | (2006.01) |
| *A43B 5/06* | (2006.01) |

(52) U.S. Cl.

CPC ..... *A43B 13/127* (2013.01); *A43B 13/148* (2013.01); *A43B 13/186* (2013.01); *A43B 5/06* (2013.01)

(58) Field of Classification Search

CPC .. A43B 7/06; A43B 7/08; A43B 7/085; A43B 7/12; A43B 7/125; A43B 23/06; A43B 13/18; A43B 13/181; A43B 13/186; A43B 13/188

USPC ..... 36/88, 91, 25 R, 31

See application file for complete search history.

(56) References Cited

U.S. PATENT DOCUMENTS

| | | | | |
|---|---|---|---|---|
| 6,163,982 | A * | 12/2000 | Ellis, III | A43B 13/143 36/114 |
| 8,984,770 | B1 * | 3/2015 | Piontkowski | A43B 7/141 36/25 R |
| 2002/0017038 | A1 * | 2/2002 | Umezawa | A43B 13/02 36/31 |
| 2010/0269376 | A1 * | 10/2010 | Flannery | A43B 13/181 36/30 R |
| 2014/0259784 | A1 * | 9/2014 | Jenkins | A43B 13/184 36/102 |
| 2015/0250260 | A1 * | 9/2015 | Bessho | A43B 7/18 36/25 R |
| 2017/0035143 | A1 * | 2/2017 | Sato | A43B 7/148 |
| 2017/0119091 | A1 * | 5/2017 | Bischoff | A43B 13/125 |
| 2019/0053571 | A1 * | 2/2019 | Bjornson | A43B 7/1445 |
| 2020/0170339 | A1 * | 6/2020 | Verfl | A43B 13/181 |

* cited by examiner

*Primary Examiner* — Marie D Bays

(74) *Attorney, Agent, or Firm* — Barry Choobin; Patent 360

(57) ABSTRACT

A midsole for sports shoes having a front isolation cavity, a side cavity, and a rear isolation cavity partially separating the recessed arch portion of the midsole from the rest of the midsole.

20 Claims, 11 Drawing Sheets

RUNNING SHOE

FIELD OF INVENTION

The present invention relates to a running shoe, and more particularly, the present invention relates to a shoe for both normal running and controlling pronation.

BACKGROUND

Modern running shoes are not just designed for protection and comfort but to improve running performance. Depending on the type of running activity (trail running, road training, long-distance competitions, etc.) and the type of gait, the midsole must perform with a mix of distinctive characteristics i.e., cushion, support, and energy return. The cushioning of the midsole softens the impacts received at every stride and so the heel area of the shoe generally has thicker cushioning. For saving energy, the midsole can behave as a compressed spring that returns a portion of energy helping the athlete in the toe-off phase. Thus, the shoe has to be soft, firm, and elastic which are in contrast to each other. To have good cushioning, the midsole should have good dampening characteristics. For being supportive, it should be firm, fundamentally hard. And to be energy efficient it should be resilient. Also are known stability shoes that are designed for a runner who needs help correcting their running form or shows moderate to severe pronation. The technology in "Stability Shoes" helps bring the foot into a neutral alignment. All running shoe companies have different technologies, but fundamentally they aim to restrict the foot from rolling inward while the sole has firm contact with the ground. The companies spent a huge fortune in designing midsoles having a combination of materials for desired cushioning in the heel area while firmness in the arch area. Moreover, the combination of materials may also be designed to provide the resiliency for energy pushback. This increases the cost of the shoe and the shoe designed to control over-pronation may have too much firmness in the arch area making it unsuitable for normal foot running.

A desire is there a shoe or midsole that is economical to manufacture and can provide for both normal running and controlling overpronation.

SUMMARY OF THE INVENTION

The following presents a simplified summary of one or more embodiments of the present invention in order to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments in a simplified form as a prelude to the more detailed description that is presented later.

A principal object of the present invention is therefore directed to a midsole for sports shoes that is suitable for normal foot and overpronating foot.

It is another object of the present invention that the midsole can be made of a single material.

It is a further object of the present invention that the midsole provides for enhancing athletic performance.

It is yet another object of the present invention that the midsole is economical to manufacture.

It is still a further object of the present invention that the midsole does not require specialized equipment for manufacture.

It is an additional object of the present invention that the midsole provides desired cushioning for running.

In one aspect, disclosed is a midsole for sports shoes having a front isolation cavity, a side cavity, and a rear isolation cavity partially separating the recessed arch portion from the rest of the midsole.

In one aspect, the cavities are deep cutouts in the sole that allow the sole to bend relative to the cavity. The resiliency of the material of the midsole and the cavity surrounding the recessed arch portion allows the recessed arch portion to deform from a concave shape up to a flat profile under external pressure and regain its shape when the external pressure is removed.

These and other objects and advantages of the embodiments herein and the summary will become readily apparent from the following detailed description taken in conjunction with the accompanying drawings

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

Figure 1:
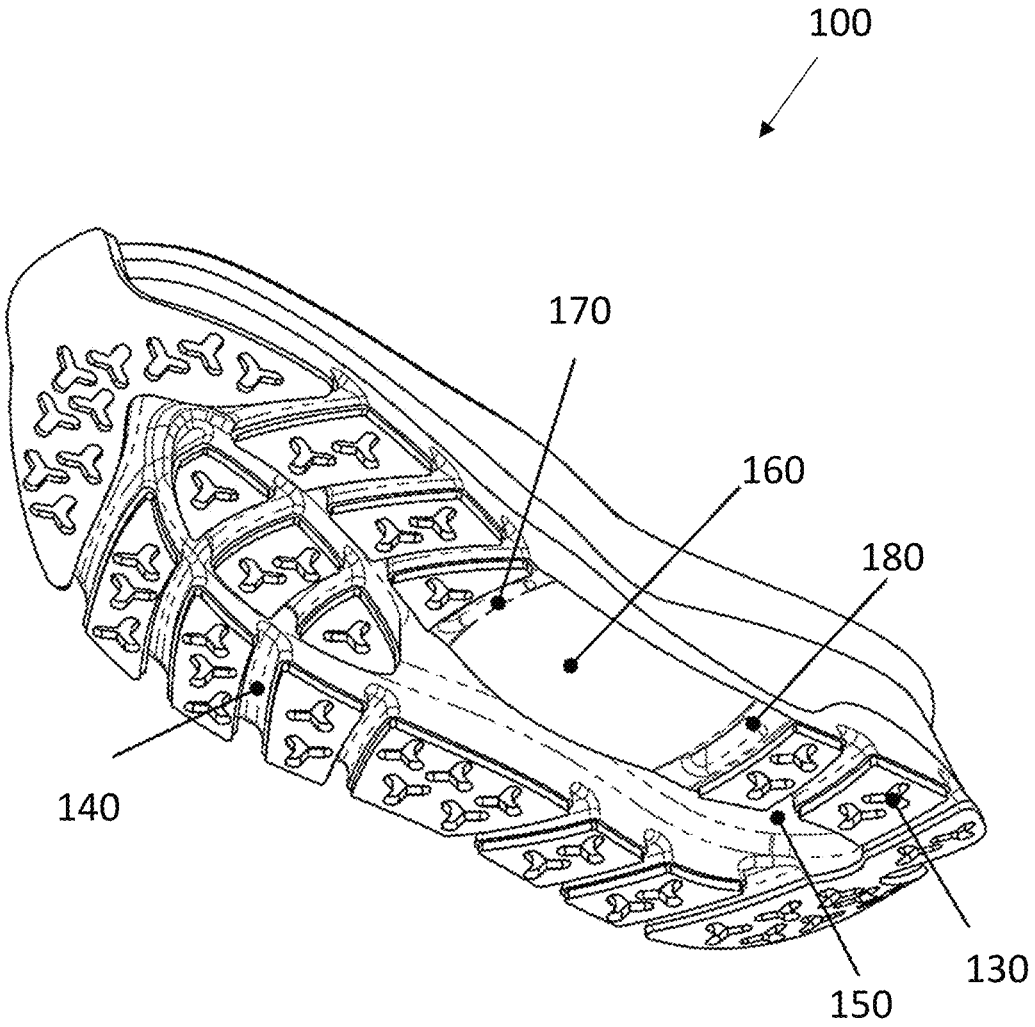
FIG. 1 is a bottom isometric view of the midsole, according to an exemplary embodiment of the present invention.

Disclosed is a midsole for sports shoes that can enhance athletic performance in both normal foot and pronating foot gait cycle. Referring to FIG. 1 which is an isometric view of the midsole 100 having an outsole 130. The outsole 130 can have different patterns is the outermost part of a shoe that contacts the ground providing traction. The outsoles also protect the midsole against damage. The outsole is generally made of synthetic rubbers, such as Styrene-Butadiene Rubber, Acrylonitrile-Butadiene Rubber, and like rubbers known for use in the outsole of shoes that offer good grip on different surfaces and having abrasion resistance properties. The bottom of the midsole is having several flex cuts 140 that are designed to allow the shoe to progressively bend following the contour of the foot. Moreover, the flex cuts 140 also provide some added traction in loose ground. An elongate central cavity 150 can also be seen in the bottom of the midsole 100. The elongated central cavity 150 allows the front foot joints to adapt to the ground and in the rear portion. Central cavity 150 can be seen in FIGS. 5A, 5C, and 7A. The elongated central cavity 150 can help in spreading the load from the weight to the outside of the heel increasing the stability.

Referring to FIG. 1 which also shows a recessed portion 160 in the medial to the arch side of the midsole at its bottom. The recessed portion is of a concave shape that can support the arch of the foot. Adjacent the recessed portion 160 can be seen a front isolation cavity 170 and a rear isolation cavity 180. Additionally, the elongated central cavity 150 in the bottom of the midsole forms a lateral side of the recessed portion 160. The front isolation cavity 170, the rear isolation cavity 180, and the side cavity 150 allow the recessed portion 160 to be depressed from a concave shape up to a flat profile under an external force and regain its concave shape when the external force is removed. The front isolation cavity 170, the rear isolation cavity 180, and the side cavity 150 partially separated the recessed portion 160 from the rest of the midsole.

Figure 2:
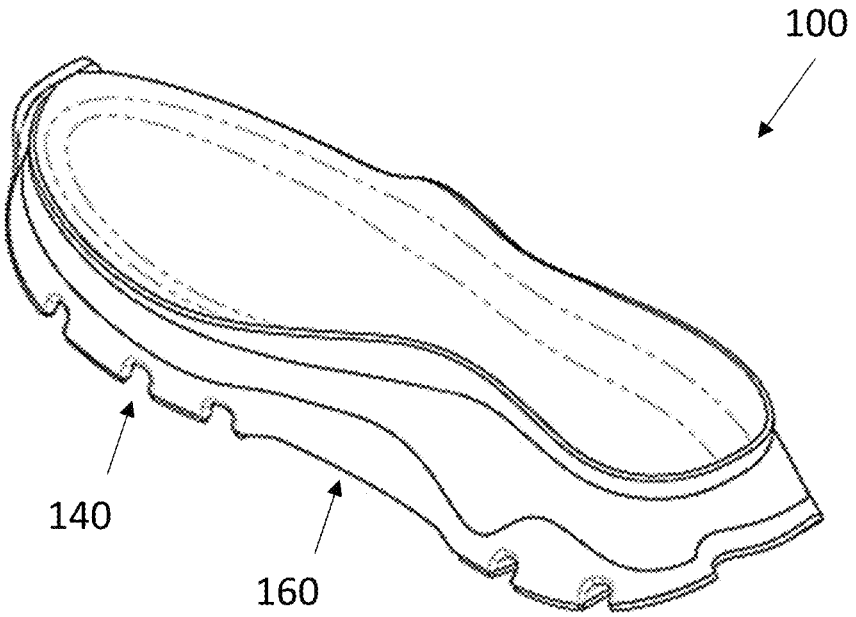
FIG. 2 is a medial side isometric view of the midsole, according to an exemplary embodiment of the present invention.
Figure 3:
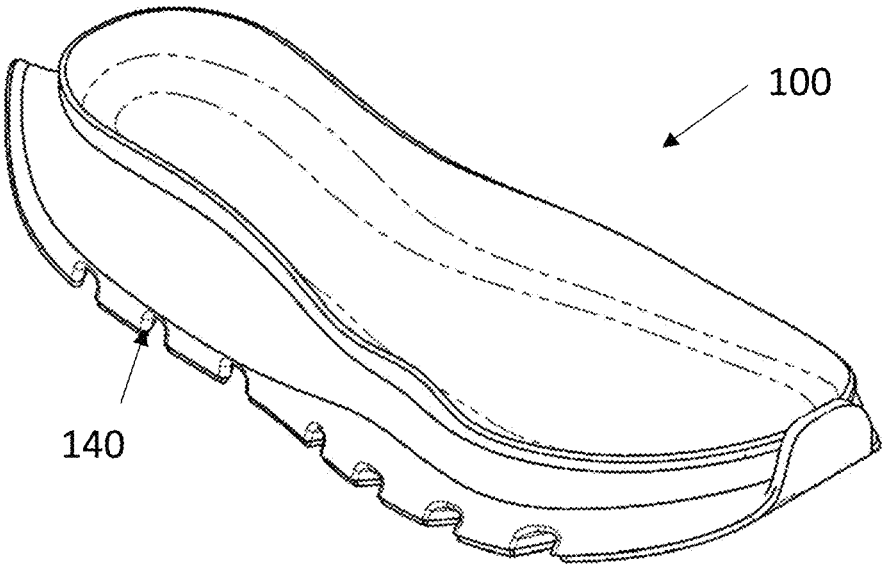
FIG. 3 is a lateral side isometric view of the midsole, according to an exemplary embodiment of the present invention.
Figures 4A, 4B, 4C, 4D:
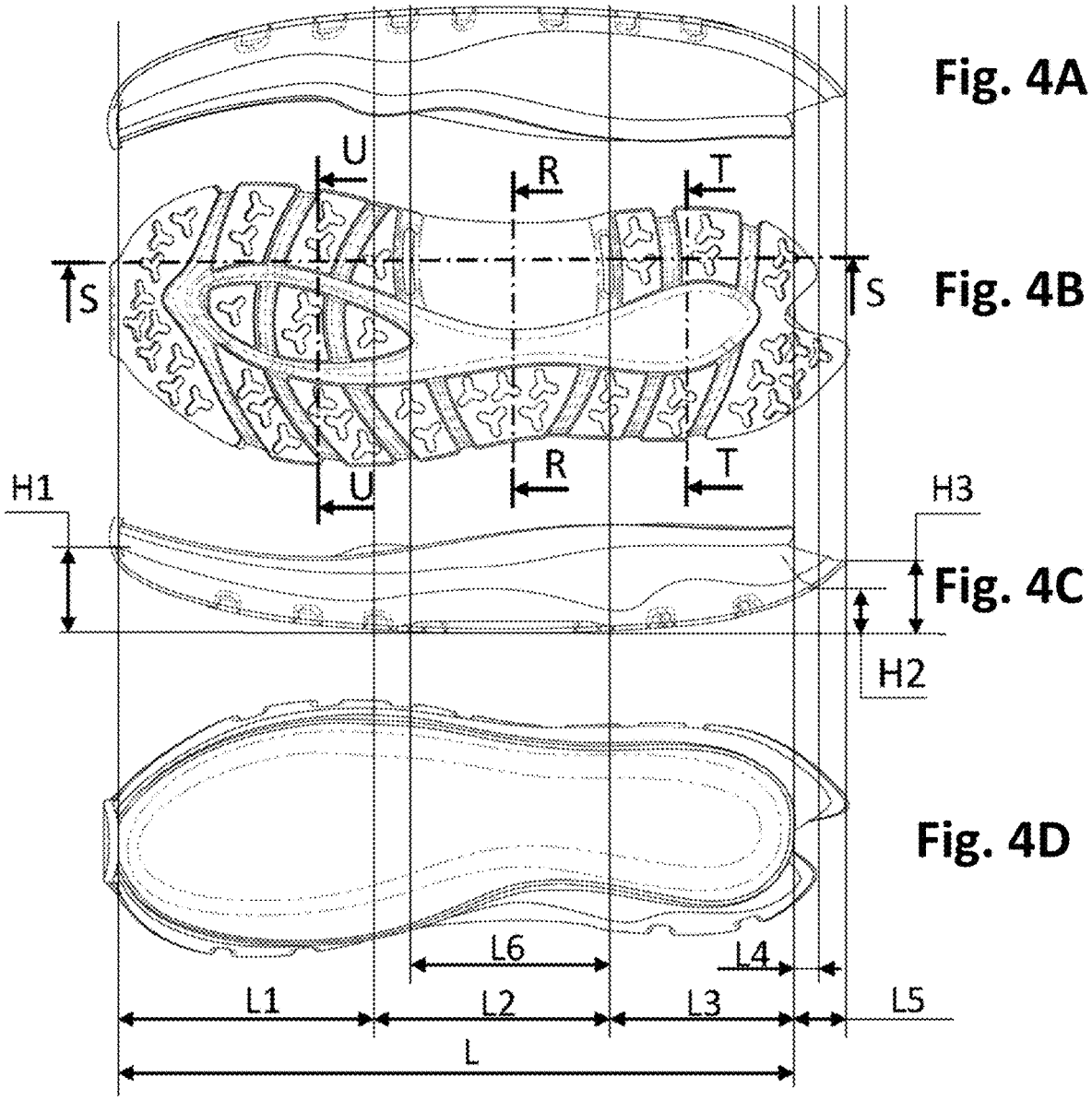
FIG. 4A is a lateral side view of the midsole, according to an exemplary embodiment of the present invention.
FIG. 4B is a bottom view of the midsole, according to an exemplary embodiment of the present invention.
FIG. 4C is a medial side view of the midsole, according to an exemplary embodiment of the present invention.
FIG. 4D is a top view of the midsole, according to an exemplary embodiment of the present invention.

Although, the whole midsole can be an integral unit, the front isolation cavity 170, the rear isolation cavity 180, and the side cavity 150 permit the recessed portion 160 to deform differently from the rest of the midsole. A protonating foot during a gait cycle push the arch area of the midsole causing the recessed portion 160 of the midsole to be depressed. The recessed portion 160 perhaps can support the arch of the protonating foot for controlling the protonation. Moreover, the recoiling depressed recessed portion 160 also pushes the arch of the foot back further controlling the protonation. FIG. 2 shows the medial side perspective view of the midsole having the flex cuts 140 and recessed portion 160 forming the arch of the midsole 100. FIG. 3 is another isometric view showing the lateral side of the midsole 100. Flex cuts 140 can also be seen in FIG. 3. FIG. 4A-4D shows the top, bottom, medial, and lateral sides of the midsole 100. FIG. 4A is the lateral side of the midsole. FIG. 4B shows the bottom side of the midsole. FIG. 4C shows the medial side and FIG. 4D shows the top of the midsole. Referring to FIG. 4D, "L' is the effective length of the midsole, where the midsole meets the shoe last. The shoe last may represent the anatomical information of the foot, at the same time giving the finished shoe a pleasing and fashionable appearance. The top of the shoe can be made around the shoe last. The midsole can have the dimension such as the section L1 may be of a dimension ranging between 35 and 40% of the length L of the midsole, section L2 can be of a dimension ranging between 25 and 35% of the length L of the midsole. Section L3 can be a dimension ranging between 20 and 30% of the length L. Section L4 can be if a value ranging between 5 and 8% of the length L. Section L5 can be of a dimension ranging between 5 and 10% of the length L. The height of the midsole shown by letter H1 in FIG. 4C can be in a range between 10 to 15% of the length L. Height of the midsole section indicated by letter H2 in FIG. 4C can have a value ranging between 8 and 10% of the length L, height of the recessed portion indicated by H3 in FIG. 4C can be in the range between 12 to 15% of the length L.

Figure 5A:
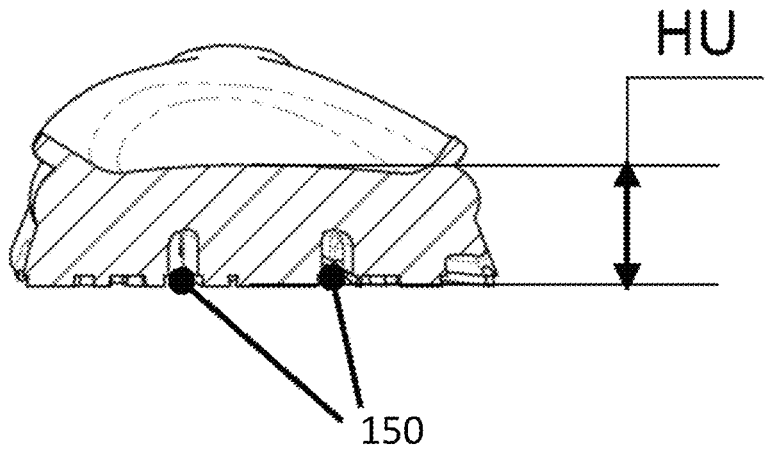
FIG. 5A is a cross-sectional view of FIG. 4B along line U-U, according to an exemplary embodiment of the present invention.
Figure 5B:
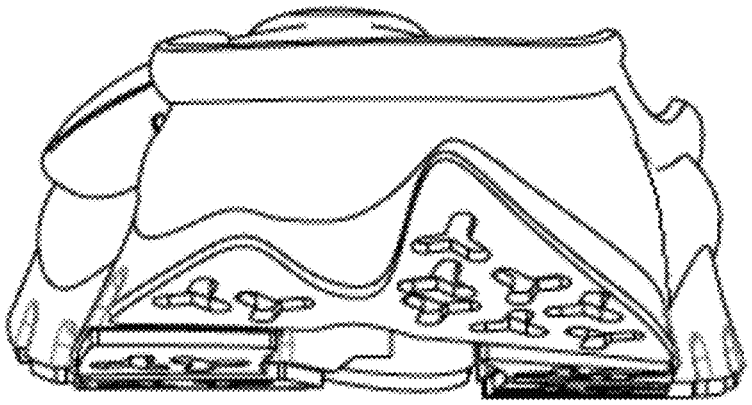
FIG. 5B is a rear view of the midsole shown in FIG. 4B, according to an exemplary embodiment of the present invention.
Figure 5C:
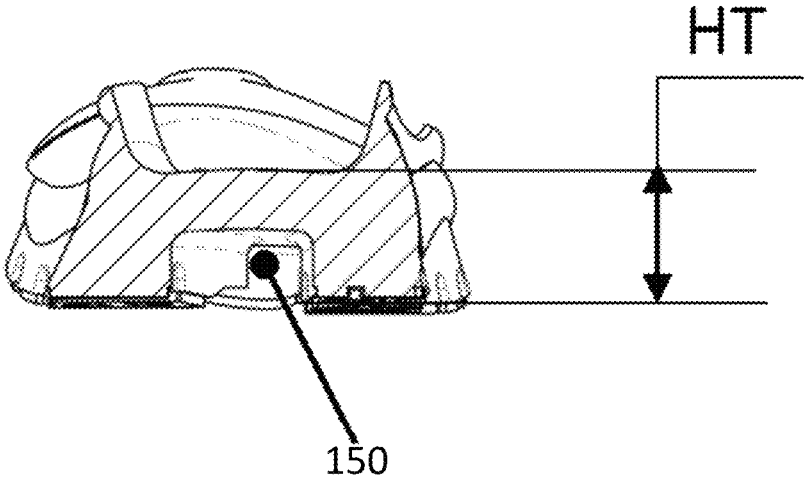
FIG. 5C is a cross-sectional view of FIG. 4B along line T-T, according to an exemplary embodiment of the present invention.
Figure 5D:
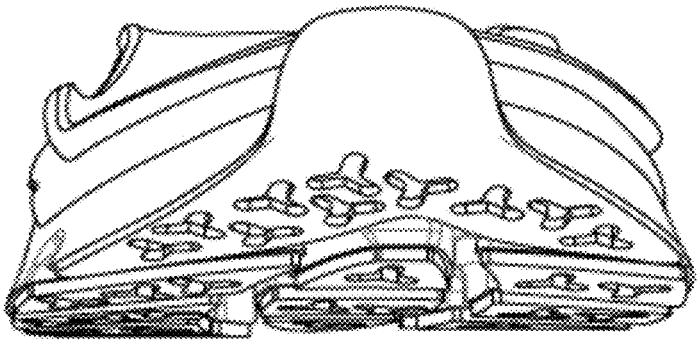
FIG. 5D is a front view of the midsole shown in FIG. 4B, according to an exemplary embodiment of the present invention.

FIG. 5A is a cross-section of the ball (forefoot) portion of the midsole shown in FIG. 4B along the line U-U, showing the central cavity 150 and toe of the midsole. The height of the ball section of the midsole can be in the range of 8 to 10% of the length L, shown by HU in FIG. 5A. FIG. 5B shows the rear side of the midsole. FIG. 5C is a cross-section of the heel section of the midsole shown in FIG. 4B along the line T-T. The central cavity 150 can also be seen in FIG. 5C. The Height of the heel section of the midsole can be in the range between 10 to 15% of the length L, indicated by HT. FIG. 5D shows the front view of the midsole showing the toe section. FIG. 6 again shows the bottom of the midsole 100 having the recessed portion 160 surrounded by the front isolation cavity 170, a rear isolation cavity 190, and a central cavity 150.

Figure 6:
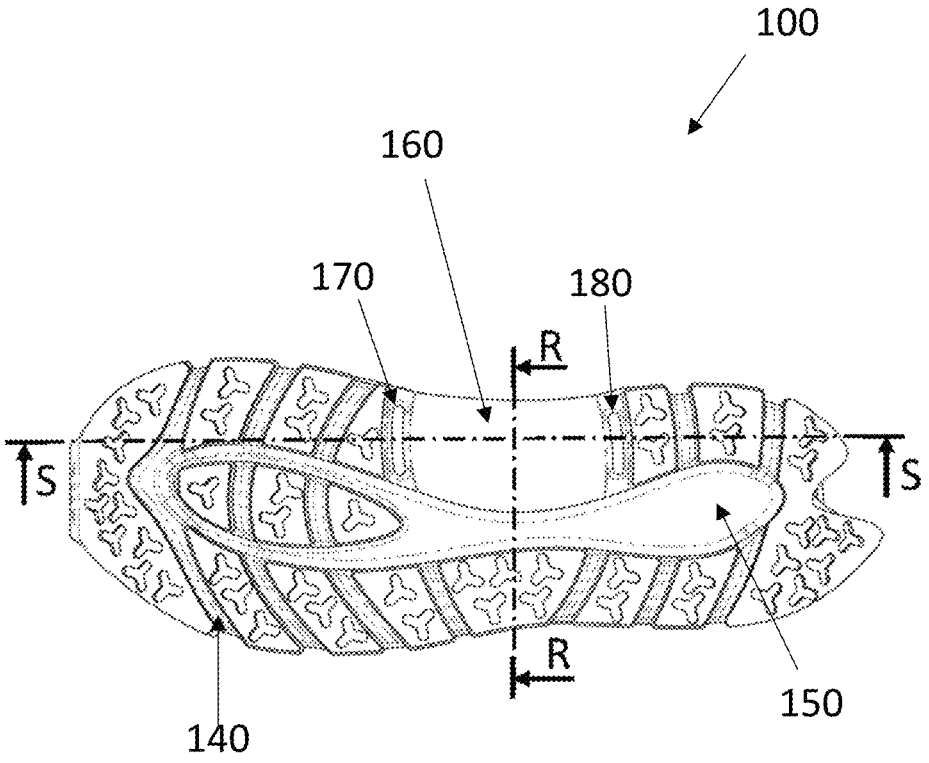
FIG. 6 is a bottom view of the midsole, according to an exemplary embodiment of the present invention.
Figure 7A:
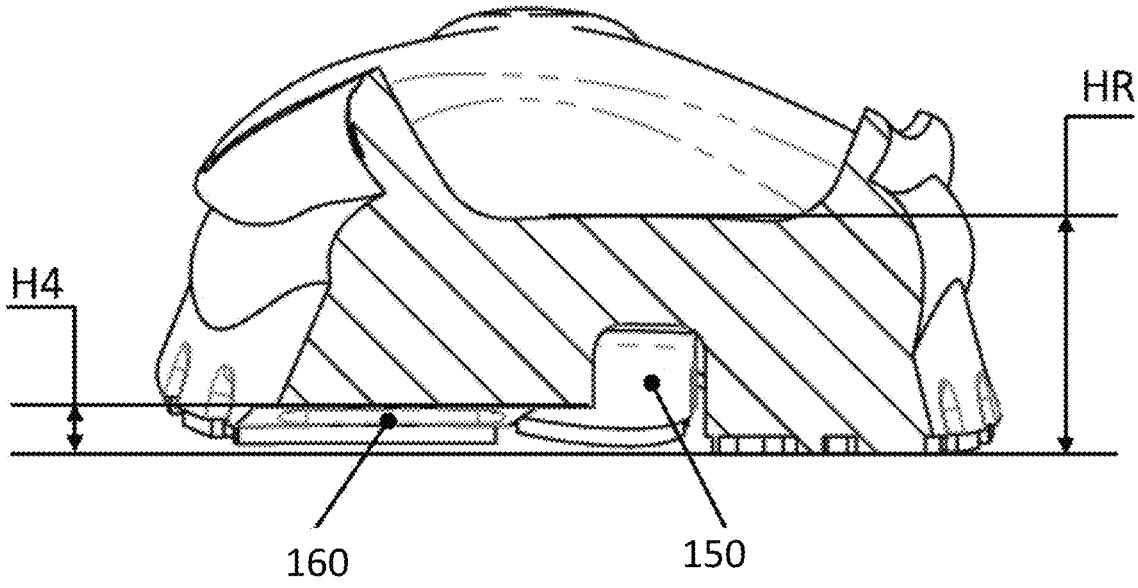
FIG. 7A is a cross-sectional view of the midsole shown in FIG. 6 along line R-R, according to an exemplary embodiment of the present invention.

FIG. 7A is a cross-sectional view of the midsole shown in FIG. 6 along the line S-S showing the arch portion of the midsole. The height of the recessed area 160 above the ground is shown by H4 can be in the range between 0.5 to 3% of the length L, while the height of the sole, indicated by HR can be in a range of about 10 to 12% of the length L.

Figure 7B:
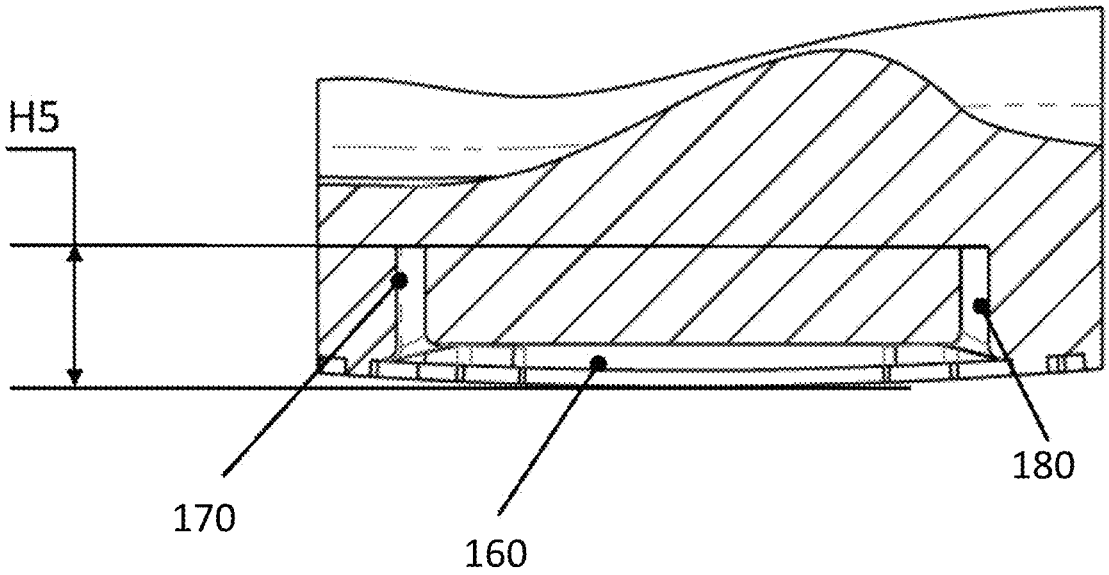
FIG. 7B is a cross-sectional view of the midsole shown in FIG. 6 along line S-S, according to an exemplary embodiment of the present invention.

FIG. 7B shows the lateral section of the midsole shown in FIG. 6 along the line S-S. FIG. 7B shows the recessed portion 160, front isolation cavity 170, and rear isolation cavity 180. The height of front isolation cavity 170 and the rear isolation cavity 180 are indicated by height H5 can be in the range between 5 to 8% of the length L.

Figure 8A:
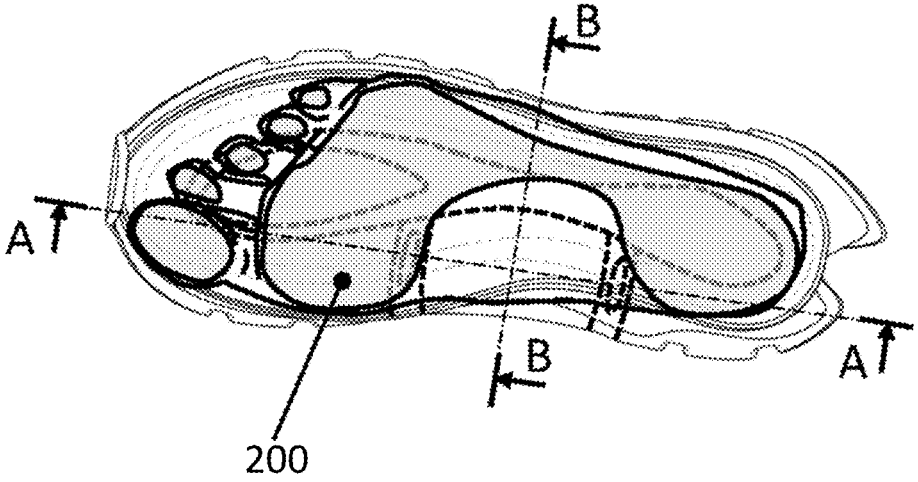
FIG. 8A is a schematic bottom view of the midsole showing the contact zone of the neutral foot during gait, according to an exemplary embodiment of the present invention.
Figure 8B:
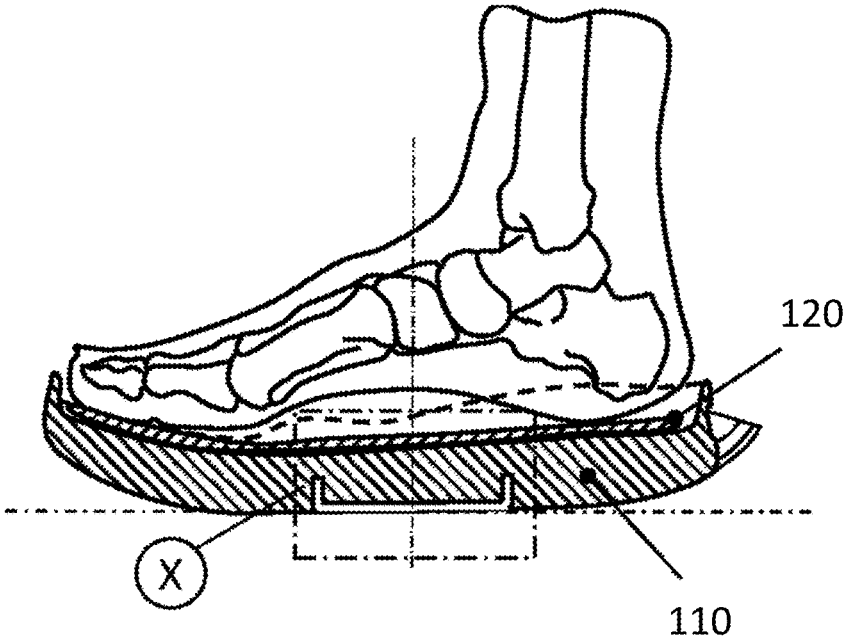
FIG. 8B is a cross-sectional view of the midsole shown in FIG. 8A along line A-A, according to an exemplary embodiment of the present invention.
Figure 8C:
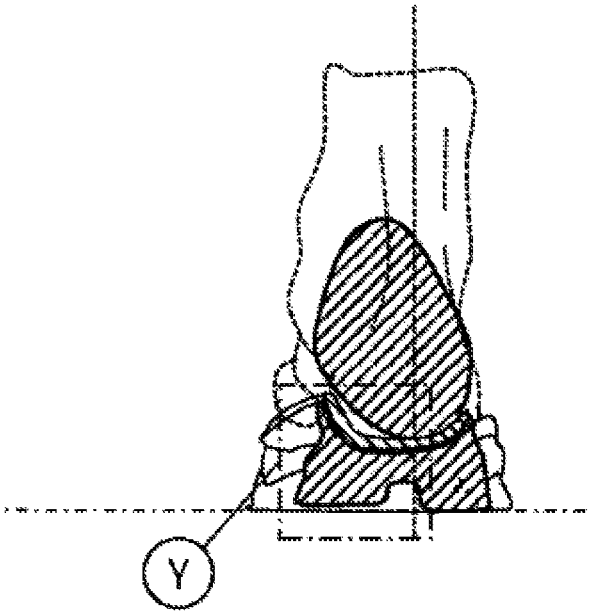
FIG. 8C is a cross-sectional view of the midsole shown in FIG. 8A along line B-B, according to an exemplary embodiment of the present invention.
Figure 8D:
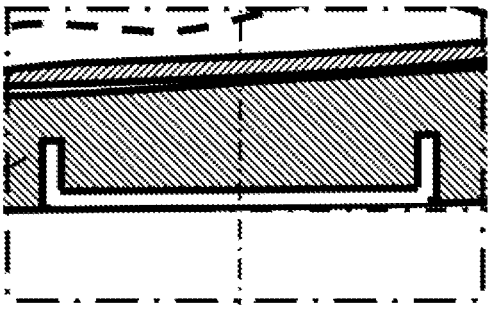
FIG. 8D is a sectional view "X" of FIG. 8B, according to an exemplary embodiment of the present invention.
Figure 8E:
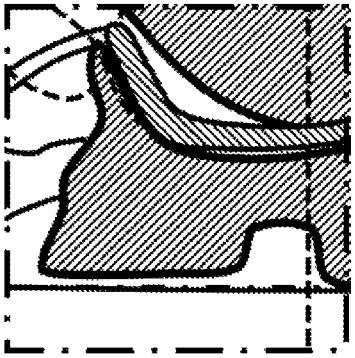
FIG. 8E is a sectional view "Y" of FIG. 8C, according to an exemplary embodiment of the present invention.

FIG. 8A-8E shows the midsole reacting to an impact of a neutral foot on the ground. FIG. 8 shows the neutral foot compressing the midsole during gait midstance. The compression area of the foot in the neutral foot during gait is shown by grey color zone 200. The arch of the neutral foot does not contact the ground. FIG. 8B is a cross-sectional view of the midsole shown in FIG. 8A along line A-A. FIG. 8B also shows the insole 120. The structure and functioning of the insoles are known in the art for additional cushioning. FIG. 8C is a cross-sectional view of the midsole shown in FIG. 8A along the lines B-B. It can be seen in FIGS. 8B and 8C that the foot arch does not contact the insole or midsole of the shoe. Furthermore, sectional views in FIGS. 8D and 8E also clearly show the recessed area not being compressed against the ground.

Figure 9A:
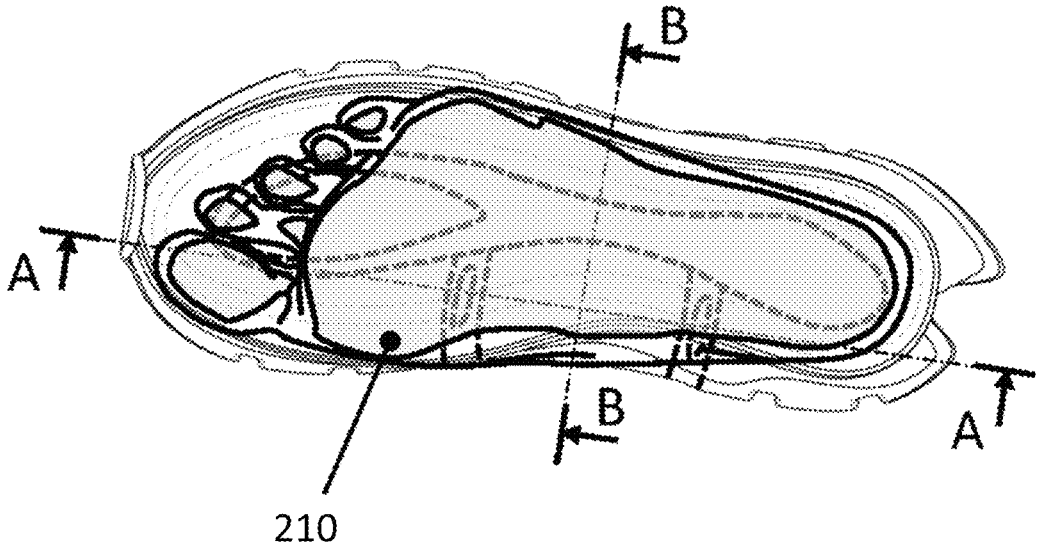
FIG. 9A is a schematic bottom view of the sole showing the contact zone of a pronating foot during gait, according to an exemplary embodiment of the present invention.
Figure 9B:
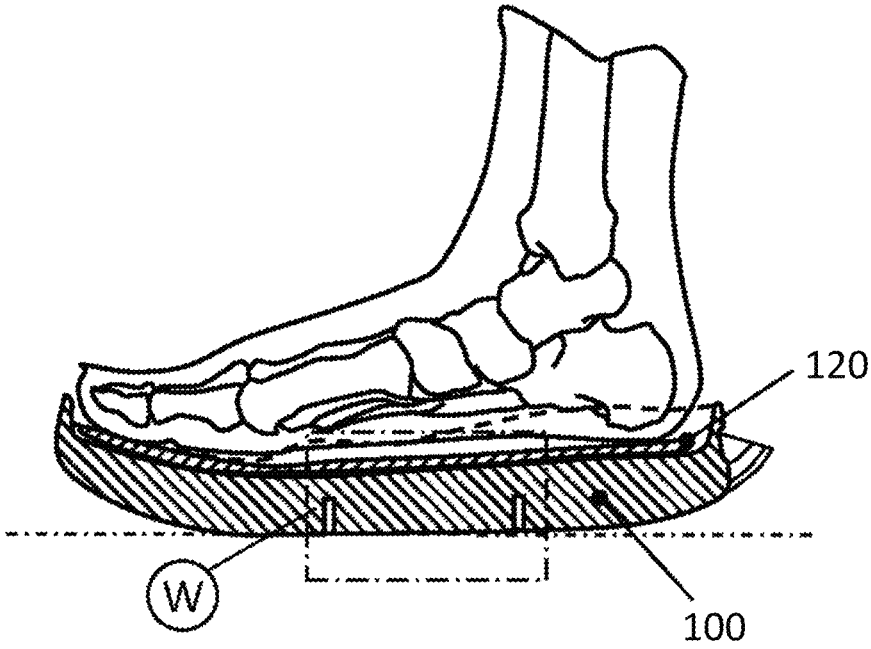
FIG. 9B is a cross-sectional view of the midsole shown in FIG. 9A along line A-A, according to an exemplary embodiment of the present invention.
Figure 9C:
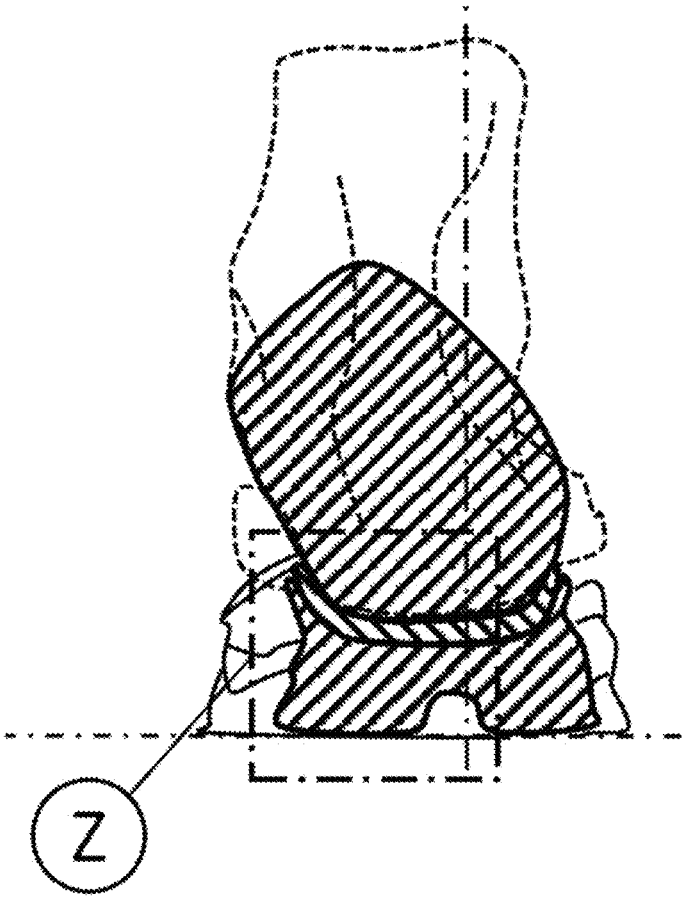
FIG. 9C is a cross-sectional view of the midsole shown in FIG. 9A along line B-B, according to an exemplary embodiment of the present invention.

Referring to FIG. 9A to 9E which shows the midsole functioning against the pronating foot. FIG. 9A shows the pronating foot compressing the midsole during gait midstance. The compression area of the foot in the pronating foot during gait is shown by grey color zone 210. FIG. 9B is a cross-sectional view of the midsole shown in FIG. 9A along line A-A. FIG. 9C is a cross-sectional view of the midsole shown in FIG. 9A along the lines B-B. The recessed area can be seen being relatively disjoined from the rest of the midsole reacts under the foot arch creating the needed support. The advantage of the arrangement is that the proper support of pronating feet is obtained through the shape of a disjoined area creating compression reactions that will bring the shape of the arch back to the proper shape. Thus, one density material, such as PEBA (Polyether Block Amide), EVA (Ethylene-Vinyl Acetate), or TPU (Thermoplastic polyurethane) can be used for the midsole which reduces the cost of the midsole tooling.

What is claimed is:

1. A midsole comprising:

a recessed arch portion;

a front isolation cavity at a front side of the recessed arch portion, the front isolation cavity extends along a width of the midsole;

a rear isolation cavity at a rear side of the recessed arch portion, the rear isolation cavity extends along the width of the midsole; and a central cavity in the midsole forming a lateral side of the recessed arch portion, the central cavity extends along a length of the midsole a front right bridge separates the front isolation cavity and the central cavity, a rear right bridge separates the rear isolation cavity and the central cavity, the front isolation cavity extends between the front right bridge and a front left bridge, the rear isolation cavity extends between the rear right bridge and a rear left bridge, wherein the front isolation cavity, the rear isolation cavity, and the central cavity partially separates the recessed arch portion from a rest of the midsole, wherein the recessed arch portion is configured to deform from a substantially concave shape up to a substantially flat profile under an external pressure and regains the original shape upon release of the external pressure, wherein the front right bridge, the front left bridge, the rear right bridge, and the rear left bridge are integral with the recessed arch portion and the rest of the midsole, and wherein the front left bridge and rear left bridge are along a medial side of the midsole.

2. The midsole according to claim 1, wherein the midsole is having a unitary structure of a uniform composition.

3. The midsole according to claim 1, wherein the partial separation of the recessed arch portion from the rest of the midsole permits the of the recessed arch portion to deform independently from the rest of the midsole and the recessed arch portion configured to support an arch of a protonating foot.

4. The midsole according to claim 1, wherein a height of the recessed arch portion above a ground surface is in a range of about 0.5-3.0% of an effective length of the midsole.

5. The midsole according to claim 4, wherein a depth of the front isolation cavity and the rear isolation cavity is in a range of about 5-8% of the effective length of the midsole.

6. The midsole according to claim 5, wherein a height of the midsole is in a range of about 10-15% of the effective length of the midsole.

7. The midsole according to claim 6, wherein a height of a ball section of the midsole is in a range of about 8-10% of the effective length of the midsole.

8. The midsole according to claim 7, wherein a height of a heel section of the midsole is in a range of about 10-15% of the effective length of the midsole.

9. The midsole according to claim 1, wherein the central cavity extends from a ball section of the midsole to a heel section of the midsole, wherein the central cavity is narrowest in a middle adjacent to the recessed arch portion.

10. The midsole according to claim 9, wherein the midsole further comprises a plurality of flex cuts in the rest of the midsole, wherein each flex cut of the plurality of flex cuts is continuous with the central cavity.

11. A footwear comprising a midsole, the midsole comprises:

a recessed arch portion;

a front isolation cavity at a front side of the recessed arch portion, the front isolation cavity extends along a width of the midsole;

a rear isolation cavity at a rear side of the recessed arch portion, the rear isolation cavity extends along the width of the midsole; and a central cavity in the midsole forming a lateral side of the recessed arch portion, the central cavity extends along a length of the midsole a front right bridge separates the front isolation cavity and the central cavity, a rear right bridge separates the rear isolation cavity and the central cavity, the front isolation cavity extends between the front right bridge and a front left bridge, the rear isolation cavity extends between the rear right bridge and a rear left bridge, wherein the front isolation cavity, the rear isolation cavity, and the central cavity partially separates the recessed arch portion from a rest of the midsole, wherein the recessed arch portion is configured to deform from a substantially concave shape up to a substantially flat profile under an external pressure and regains the original shape on release of the external pressure, wherein the front right bridge, the front left bridge, the rear right bridge, and the rear left bridge are integral with the recessed arch portion and the rest of the midsole, and wherein the front left bridge and rear left bridge are along a medial side of the midsole.

12. The footwear according to claim 11, wherein the midsole is having a unitary structure of a uniform composition.

13. The footwear according to claim 11, wherein the partial separation of the recessed arch portion from the rest of the midsole permits the the recessed arch portion to deform independently from the rest of the midsole and the recessed arch portion configured to support an arch of a protonating foot.

14. The footwear according to claim 11, wherein a height of the recessed arch portion above a ground surface is in a range of about 0.5-3.0% of an effective length of the midsole.

15. The footwear according to claim 14, wherein a depth of the front isolation cavity and the rear isolation cavity is in a range of about 5-8% of the effective length of the midsole.

16. The footwear according to claim 15, wherein a height of the midsole is in a range of about 10-15% of the effective length of the midsole.

17. The footwear according to claim 16, wherein a height of a ball section of the midsole is in a range of about 8-10% of the effective length of the midsole.

18. The footwear according to claim 17, wherein a height of a heel section of the midsole is in a range of about 10-15% of the effective length of the midsole.

19. The footwear according to claim 11, wherein the central cavity extends from a ball section of the midsole to a heel section of the midsole, wherein the central cavity is narrowest in a middle adjacent to the recessed arch portion, the midsole further comprises a plurality of flex cuts in the rest of the midsole, each flex cut of the plurality of flex cuts is continuous with the central cavity.

20. The footwear according to claim 19, wherein the footwear further comprises an outer sole as sections of the outer sole, wherein the sections of the outer sole are provided over the rest of the midsole, wherein the recessed arch portion is plain without the outer sole, wherein each section of the outer sole extends between one or two flex cuts of the plurality of flex cuts and the central cavity.

* * * * *